US006786673B2

(12) United States Patent
Kulp et al.

(10) Patent No.: US 6,786,673 B2
(45) Date of Patent: Sep. 7, 2004

(54) ANTI-ROTATIONAL TRAFFIC CHANNELING DEVICE

(75) Inventors: Jack H. Kulp, Dana Point, CA (US); David C. Gertz, San Clemente, CA (US)

(73) Assignee: Traffix Devices, Inc., San Clemente, CA (US)

( * ) Notice: Subject to any disclaimer, the term of this patent is extended or adjusted under 35 U.S.C. 154(b) by 0 days.

(21) Appl. No.: 10/289,708

(22) Filed: Nov. 7, 2002

(65) Prior Publication Data

US 2003/0095835 A1 May 22, 2003

Related U.S. Application Data

(63) Continuation-in-part of application No. 09/470,134, filed on Dec. 22, 1999, now Pat. No. 6,478,505.
(60) Provisional application No. 60/113,203, filed on Dec. 22, 1998.

(51) Int. Cl.[7] ..... E01F 15/00
(52) U.S. Cl. ..... 404/6; 404/9; 116/63 P
(58) Field of Search ..... 404/6, 9; 248/910, 248/911; 116/63 C, 63 P, 63 R; 40/612; 256/1, 13.1

(56) References Cited

U.S. PATENT DOCUMENTS

| | | | | |
|---|---|---|---|---|
| 2,762,327 | A | 9/1956 | Weig | 116/63 |
| 2,817,308 | A | 12/1957 | Scanlon | 116/63 |
| 3,147,734 | A | 9/1964 | Knapp | 116/63 |
| 3,451,368 | A | 6/1969 | Keats | 116/63 |
| 3,952,690 | A | 4/1976 | Rizzo et al. | 116/63 |
| 4,674,431 | A | 6/1987 | Cory | 116/63 |
| D309,585 | S | 7/1990 | Kulp | 116/63 |
| 4,973,970 | A | 11/1990 | Erwin et al. | 404/9 |
| 5,026,204 | A | 6/1991 | Kulp et al. | 116/63 |
| 5,199,813 | A | 4/1993 | Nagler | 404/9 |
| 5,201,599 | A | 4/1993 | Kulp et al. | 404/6 |
| 5,234,280 | A | 8/1993 | Cowan | 404/6 |
| 5,451,118 | A | 9/1995 | Wilkins et al. | 404/6 |
| 5,613,798 | A | 3/1997 | Braverman | 404/6 |
| 5,630,675 | A | 5/1997 | Boeger | 404/6 |
| 5,713,694 | A | 2/1998 | Monda et al. | 404/9 |
| 5,722,788 | A | 3/1998 | Bent et al. | 404/6 |
| 5,735,632 | A | 4/1998 | Braverman | 404/6 |
| 5,749,673 | A | 5/1998 | Kulp et al. | 116/63 C |
| 5,755,528 | A | 5/1998 | Kulp et al. | 404/6 |
| 5,868,520 | A | 2/1999 | Kulp et al. | 404/6 |
| 6,019,542 | A | 2/2000 | Bent et al. | 404/6 |
| 6,095,716 | A | 8/2000 | Kulp et al. | 404/9 |
| 6,182,600 | B1 | 2/2001 | Brown et al. | 116/63 C |
| 6,186,699 | B1 | 2/2001 | Kulp et al. | 404/9 |
| 6,478,505 | B1 | 11/2002 | Kulp et al. | 404/6 |

OTHER PUBLICATIONS

"New Grabber Vertical Panel Barricade", 1996, Traffix Devices, Inc.

*Primary Examiner*—Thomas B. Will
*Assistant Examiner*—Alexandra K. Pechhold
(74) *Attorney, Agent, or Firm*—Stout, Uxa, Buyan & Mullins, LLP; Donald E. Stout

(57) ABSTRACT

Molded ribs are provided for use in connection with traffic channeling devices, such as drums, which employ external ballasting collars, such as molded rings or truck tire rings. The ribs are disposed at spaced intervals near the bottom of the external wall of the drum, for improving contact between the drum wall and the internal diameter of the ballasting collar, in order to eliminate undesirable separation of the drum and collar during ordinary use, and to prevent inadvertent rotation of the drum relative to the collar.

23 Claims, 4 Drawing Sheets

Fig. 4
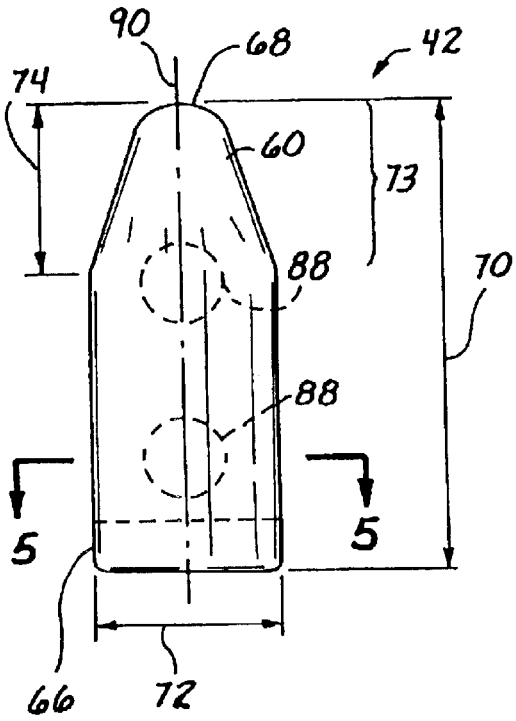
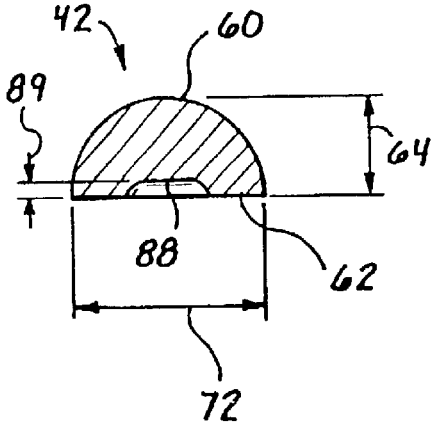
Fig. 5
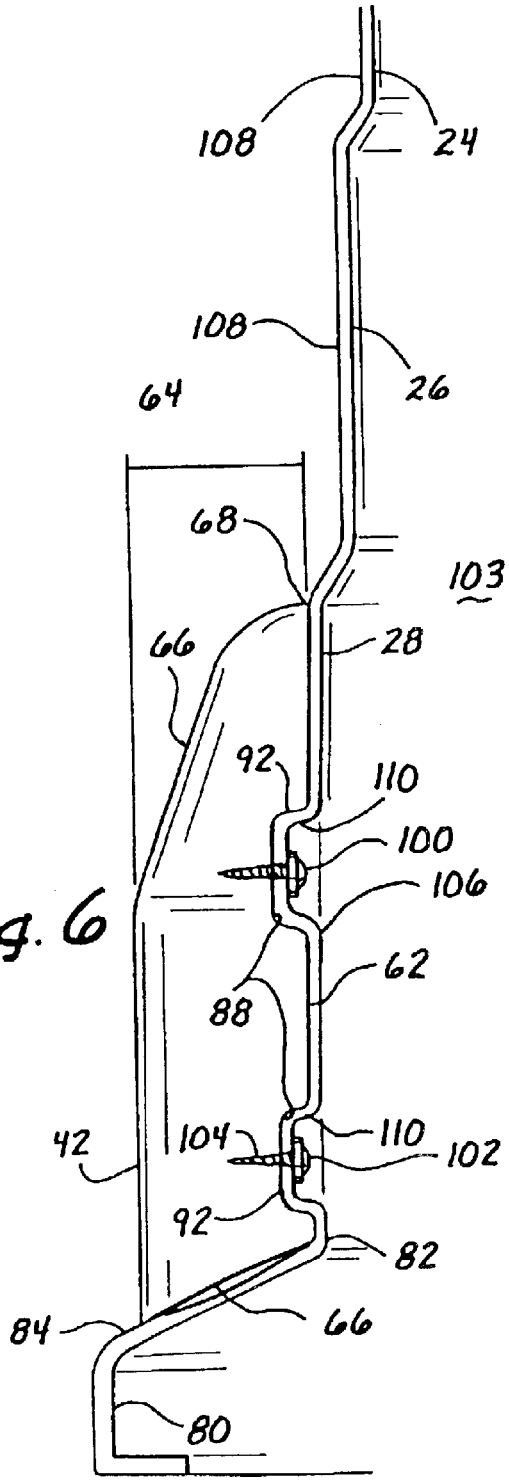
Fig. 6

ANTI-ROTATIONAL TRAFFIC CHANNELING DEVICE

This application is a continuation-in-part under 35 U.S.C. 120 of U.S. patent application Ser. No. 09/470,134, filed on Dec. 22, 1999, now U.S. Pat. No. 6,478,505, which in turn claimed the benefit under 35 U.S.C. 119(e) of U.S. Provisional Application Serial No. 60/113,203, filed on Dec. 22, 1998.

BACKGROUND OF THE INVENTION

1. Field of the Invention

This invention relates to traffic safety equipment and, more specifically, to the traffic channeling devices.

2. Description of the Related Art

Many different types of traffic channeling devices have been utilized previously. One type that has been widely used comprises a hollow drum made of a relatively lightweight plastic material which will not cause damage to a vehicle if the vehicle should accidentally strike the drum.

Because such hollow plastic drums are relatively light in weight, some type of ballast is needed to prevent the drums from being inadvertently blown over or moved about by the wind and/or air blasts produced by passing vehicles. One common form of ballast consists of sandbags which may be placed against the base of the drums.

An improvement on the sandbag ballast technique has been to use rubber collars to ballast the drum. The rubber collars, which may be recycled truck tires that have been latitudinally split, are inserted over the drum and exteriorly ballast the drum. This arrangement provided the drums with a relatively low center of gravity. The drums also grip the road over a relatively large surface area to resist tipping of the drums and eliminate "walking" of the drums on the ground which is common to plastic drums.

An example of this type of drum is disclosed in U.S. Pat. No. 5,234,280 to Cowan entitled "Traffic Channeling Devices," ("Cowan") which is incorporated herein by reference in its entirety. Cowan discloses that the drum has a stiffened skirt portion adjacent the bottom of the drums to provide enough resistance to the removal of the drum from the rubber collar so that the drums cannot be blown or sucked out from the rubber collar by the wind or passing vehicles while still allowing the drum to distort and break away from the rubber collar upon impact of the drums by a vehicle, leaving the rubber collars in place. Also, the skirt portion of the drums desirably resist rolling of the drums on the ground when dislodged or otherwise removed from the rubber collars.

Cowan also discloses that the rubber collar includes a relatively rigid inner peripheral portion surrounding the drum skirt portion where most of the weight of the rubber collar is concentrated and a relatively flexible outer peripheral portion spaced radially outwardly from the drum in substantial surface contact with the ground for better gripping to resist tipping of the drum and eliminate walking of the drum along the ground. Also, the flexible outer peripheral portions of the rubber collar resists rolling of the drums in the event the drum is completely tipped over while the collar is still in place.

The drum disclosed in Cowan has a loose fit in the rubber collar which allows the drum to flex and vibrate under traffic and wind conditions without tipping over or moving laterally. If the drum should tip over, the loose fit of the collar allows the collar to move up on the drum, making it more difficult for the drum to roll on the ground.

Unfortunately, the loose fit of the Cowan drum also permits it to rotate relative to the collar, which is highly undesirable. The drum rotation occurs from the wind and vacuum created by passing vehicles exerting a rotational or tangential force on the drum. The drum rotation is a distraction to passing motorists, creating a hazard.

It is also highly undesirably to have a drum rotate relative to the collar when a warning light is mounted to the drum. Typically, the warning light is mounted off center on the drum top. When the drum is used as a traffic channeling device, having the warning light maintain a constant position is critical for safety reasons. The traffic drum is typically positioned up with the warning light being proximate to the lane of traffic. As the drum rotates, the warning light rotates as well. If the warning light is rotated 90° or 270°, only the edge of light is visible resulting in reduced safety conditions. If the warning light is spun 180°, a passing driver might misjudge the location of the drum and strike it, which is understandably undesirable.

The problem of rotating drums and warning lights is recognized in the traffic channeling device industry. One approach to preventing the drum rotation is to staple a chunk of recycled tire to the lower outside wall of the drum. The tire chunk is positioned such that the inner perimeter of the rubber collar is disposed against it when the collar is inserted over the drum. This arrangement inhibits the drum from rotating in the rubber collar, but not without problems.

A problem with the prior art solution of inhibiting drum rotation is that the staple ends that extend through the lower outside wall of drum will scratch a second drum nested inside the first drum.

Another problem with the prior art solution is that the tire chunk is attached without precision. By not being attached with precision, an opportunity is created for the tire chunk to be misplaced. A misplaced tire chunk will need to be detached from the lower outside wall of the drum and reattached, resulting in unsightly and unnecessary punctures in the drum wall.

The tire chunk is of a single thickness, which creates at least two problems. By having a single thickness tire chunk, the insertion of the ballasting, rubber collar over the drum is difficult. The insertion difficulty arises because the tire chunk abruptly juts out from the drum wall. If the rubber collar is not inserted over the drum carefully, the collar will get caught on the top of the tire chunk and not slide down the outer surface of the tire chunk easily. A second problem is that the rubber collars may be of varying inner diameters, as they are often made from recycled tires. A single tire chunk stapled to the outside of the drum wall does not easily accommodate varying inner diameters of the rubber collars.

A further problem with the recycled tire chunk stapled to the drum outside wall is that it is an unsightly black chunk on the exterior surface of an otherwise brightly colored, well-designed traffic channeling drum.

Therefore, a traffic channeling device or traffic drum is needed that has the advantages of the drum models in the prior art, overcomes the problems associated with stapling a tire chunk to the outside surface of the drum, and does not rotate relative to a ballasting collar.

SUMMARY OF THE INVENTION

Objectives of the invention are achieved, in one embodiment, by a molded rib for attachment to an exterior surface of a bottom wall of a traffic channeling device for inhibiting the traffic channeling device from rotating relative to a rubber ballasting collar. The rib comprises an exterior surface for contact with the rubber ballasting collar, a back surface for contact with the bottom wall of the traffic channeling device, and a thickness between the exterior and back surfaces.

In a further aspect of the invention, the molded rib is comprised of rubber having a hardness of approximately 35 to 40 durometer. The molded rib may further comprise a top portion terminating in a tip, wherein the rib thickness diminishes toward the tip. The molded rib may comprise a bottom surface that complements a top surface of a base of the traffic channeling device. The back surface of at least one of the molded ribs comprises one or more cavities that complement at least one locator pin on the exterior surface of the traffic channeling device.

In a further aspect of the invention, the traffic channeling device comprises a drum.

Other objectives of the invention are met by a traffic channeling device comprising a wall having an outside surface, an inside surface, and terminating at a lower end in a base having a top surface. One or more molded ribs are attached to the wall outside surface for preventing the traffic channeling device from rotating relative to a rubber collar which may be disposed thereabout. Each rib comprises an exterior surface for contact with a rubber collar, a back surface in contact with the wall outside surface, and a thickness between the exterior and back surfaces. The ribs are preferably disposed about the wall outside surface in a latitudinal arc of less than 180°.

In a further aspect of the invention, the traffic channeling device comprises at least one locator pin extending from the wall outside surface and into a respective complementing cavity in the back surface of at least one of the ribs. There are also recesses in the wall inside surface that respectively correspond to at least one of the locator pins. Further, there are fasteners for mechanically attaching each rib to the traffic channeling device, each fastener comprising a first portion and a second portion, wherein the first portion is disposed in a respective recess such that the first portion does not extend beyond the wall inside surface and the second portion extends from the first portion, through the wall, and into a respective rib. In aspects of the invention, the fasteners may comprise a plurality of screws, nails, staples, or a combination thereof.

In a further aspect of the invention, the traffic channeling device has two ribs that are attached to the wall outside surface. Each of the ribs has two vertically aligned recesses that respectively complement two locator pins. Further, the fasteners comprise a plurality of screws.

In a further aspect of the invention, the ribs of the traffic channeling device comprise a top portion terminating in a tip, wherein the rib thickness diminishes toward the tip; a bottom surface that complements a top surface of the base; and rubber having a hardness of approximately 35 to 40 durometer.

In a further aspect of the invention, the base may comprise a radially outwardly and axially downwardly tapering skirt portion adjacent to a bottom edge of the traffic channeling device. In an additional aspect of the invention, the base may also comprise a flange that extends radially outwardly from a bottom edge of the traffic channeling device.

In a further aspect of the invention, a rubber collar is inserted over the traffic channeling device, the rubber collar comprising an inner diameter that is in contact with a portion of the wall outside surface and a portion of each rib exterior surface. Further, the recesses in the wall inside surface respectively correspond to at least one of the locator pins. Additionally, a plurality of screws attach the ribs to the wall, each screw having a head and body, wherein the screw head is disposed in a respective recess and the screw body extends from the screw head, through the wall, and into a respective rib, wherein two ribs are attached to the wall outside surface, and each rib comprises two vertically aligned cavities that respectively complement two locator pins extending from the wall outside surface.

Other objectives of the invention are met by a traffic channeling device comprising a wall having an outside surface and terminating in a base having a top surface. One or more ribs extend from the wall outside surface for preventing the traffic channeling device from rotating inside a rubber collar. Each rib comprises a rib exterior surface for contact with the rubber collar and a thickness between the rib exterior surface and the wall outside surface. The ribs are disposed about the wall outside surface in a latitudinal arc of less than 180°.

Other objectives of the invention are met by a traffic channeling device comprising a drum, a base, two sets of locator pins extending from the drum, one or more molded ribs, recesses in the wall inside surface of the drum, and screws. The drum has a wall having an outside surface, an inside surface, and terminating at a lower end. The base extends from the drum lower end and having a top surface. The two sets of two locator pins extend radially from the wall outside surface, wherein the locator pins of each set are vertically aligned and the two sets of two locator pins are disposed about the wall outside surface in a latitudinal arc of less than 180°. The molded ribs are attached to the wall outside surface for preventing the traffic channeling device from rotating relative to a rubber collar which may be disposed thereabout. Each rib comprises an exterior surface for contact with a rubber collar; a back surface in contact with the wall outside surface; a thickness between the exterior and back surfaces; a top portion terminating in a tip, wherein the rib thickness diminishes toward the tip; a bottom surface that complements the base top surface; rubber having a hardness of approximately 35 to 40 durometer; and two cavities that complement a respective set of locator pins. The recesses in the wall inside surface respectively correspond to at least one of the locator pins. The screws attach the ribs to the wall, each screw having a head and body, wherein the screw head is disposed in a respective recess and the screw body extends from the screw head, through the wall, and into a respective rib, thereby attaching the two ribs to the wall outside surface.

Other objectives of the invention are met by a process for inhibiting a traffic channeling device from rotating relative to a rubber collar while the rubber collar is inserted over the traffic channeling device. The process comprises a step of providing two or more molded ribs comprising an exterior surface for contact with the rubber collar, a back surface for contact with a wall outside surface of the traffic channeling device, and a thickness between the exterior and back surfaces. The process comprises another step of placing the rib back surfaces against the wall outside surface in a latitudinal arc of less than 180°. The process comprises an additional step of attaching the ribs to the wall outside surface.

In a further aspect of the invention, the process further comprises the step of inserting the rubber collar over the drum, the rubber collar comprising an inner diameter that is in contact with a portion of the wall outside surface and a portion of each rib exterior surface.

In additional aspects of the invention, the process steps may be further modified. For example, the placing step may further comprise the step of aligning a cavity in the rib back surface with a locator pin extending from the wall outside surface. The directing step may further comprise the step of screwing a screw through the wall and into the rib, with a head of the screw disposed in a recess in a wall inside surface that respectively corresponds to one of the locator pins such that the screw head does not extend beyond the wall inside surface. The providing step may further comprise providing two molded ribs comprising two back surface cavities. The aligning step may further comprise aligning the two back surface cavities with two vertically aligned locator pins. The screwing step may further comprise the step of screwing a plurality of screws through the locator pins.

In a presently preferred embodiment of the present invention, the above mentioned ribs are integrally molded with the sidewall of the drum.

These and various other advantages and features of the novelty which characterize the invention are pointed out with particularity in the claims annexed hereto and forming a part hereof. However, for a better understanding of the invention, its advantages, and the objectives obtained by its use, reference should be made to the drawings which form a further part hereof, and to the accompanying descriptive matter, in which there is illustrated and described a preferred embodiment of the invention.

BRIEF DESCRIPTION OF THE DRAWINGS

FIG. 4 shows a detail of the rib of FIG. 1;

FIG. 5 is a cross-sectional view taken along lines 5—5 in FIG. 4;

FIG. 6 shows a side elevational view of the rib attached to the wall outside surface of the traffic safety drum according to an embodiment of the invention;

DESCRIPTION OF THE PREFERRED EMBODIMENTS

Figure 1:
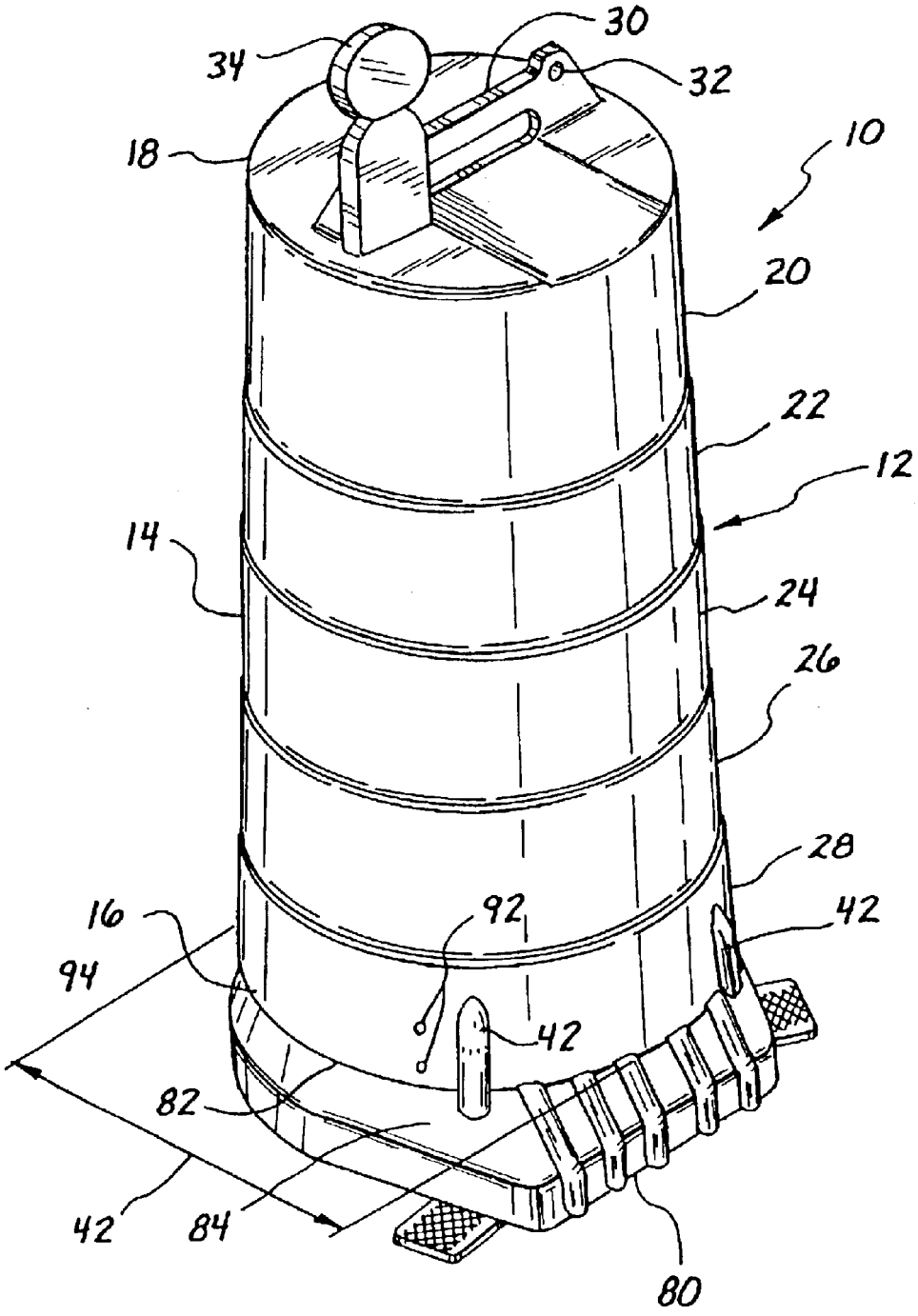
FIG. 1 shows a perspective view of a traffic safety drum with ribs according to an embodiment of the invention.

Referring to the figures, wherein like reference numerals refer to like elements throughout the figures, and referring in particular to FIG. 1, a traffic safety drum or a traffic channeling device 10 includes a relatively thin walled hollow drum 12 which is desirably blow molded out of a relatively light weight, deformable plastic material such as high or low density polyethylene. The drum 12 is desirably of a general cylindrical shape, but other embodiments of the invention may have drums of other shapes. In the shown embodiment of the invention, the drum 12 has a wall 14 that is stepped radially inwardly at discrete intervals along the axial length of the drum from the bottom 16 toward the top 18 to facilitate stacking of the drums for easy storage and to provide a plurality of axially spaced surfaces 20, 22, 24, 26, and 28 that are desirably recessed to protect bands of reflective sheeting applied to one or more of the surfaces against damage during stacking (see below in reference to FIG. 6).

Blow molding the drum 12 out of a relatively lightweight, deformable plastic material such as high or low density polyethylene has the advantage that the drums are virtually indestructible, resulting in longer product life and lower replacement cost. Making the drums out of high density polyethylene has the further advantage that they can be made lighter than low density polyethylene drums. However, low density polyethylene drums are more easily reshaped after impact than high density polyethylene drums. In either case, the drums are resistant to moisture, ultraviolet rays and temperature extremes. Moreover, polyethylene is a Class 2 recyclable plastic, whereby if any of the drums should become sufficiently damaged to require replacement, the drums can be recycled.

Protruding axially outwardly from the top 18 of the drum 12 is an integrally molded handle 30 to facilitate carrying of the drum from one location to another. Also, suitable mounting holes 32 (one shown) may be provided in the handle 30 for attachment of a warning light 34 thereto.

Figure 2:
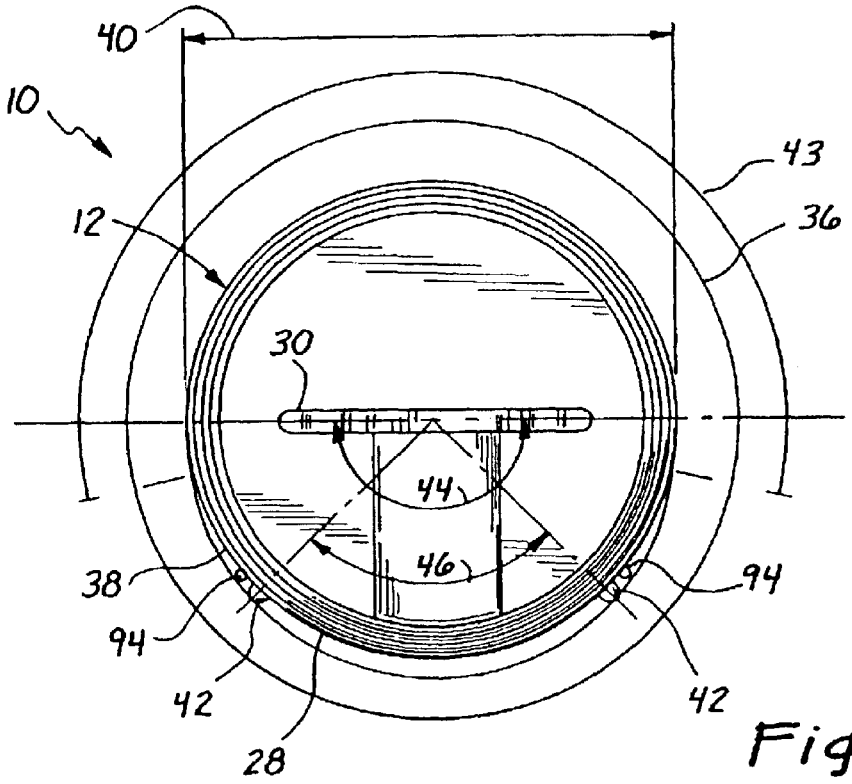
FIG. 2 shows a top view of the traffic safety drum of FIG. 1 having the ribs mounted to the wall outside surface in a first position with a rubber ballasting collar disposed thereabout.
Figure 3:
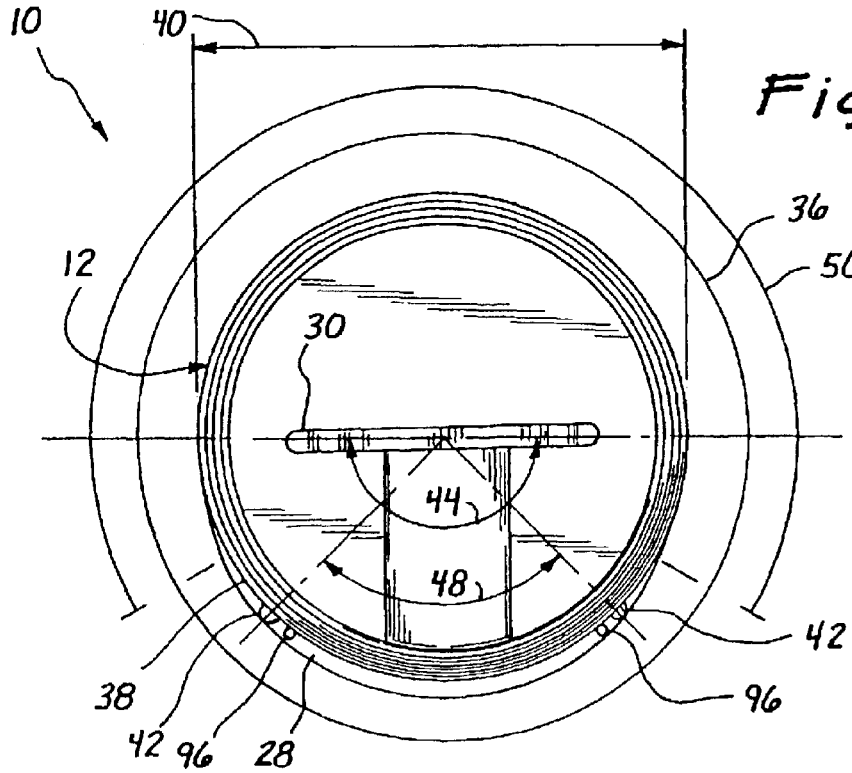
FIG. 3 shows a top view of a traffic safety drum with two ribs mounted to the wall outside surface in a second position and a rubber ballasting collar disposed thereabout according to an embodiment of the invention.

Referring now to FIGS. 2 and 3 as well, the drum 12 itself is relatively light in weight, preferably weighing between approximately 7½ and 9 pounds. To prevent the drum 12 from being blown over or inadvertently moved about by the wind and/or air currents produced by passing vehicles, the drum is ballasted in accordance with this invention by placing one or more ballasting collars 36 over the exterior of the drums. The inner perimeter 38 of the collar 36 is proximate to the axially spaced surface 28, which shall be referred to as the bottom wall 28 of the drum 12.

Preferably the rubber collars 36 are 100% recycled from worn out truck tires, and are virtually indestructible. Moreover, the collars, like the drums, are substantially impervious to moisture, U.V. rays, and temperature extremes. More preferably, the rubber collar 36 comprises the side wall of a worn out 11×22.5 steel belted radial tubeless truck tire which has an inner diameter of approximately 21¾ inches. The bottom wall 28 of the drum 12 has an outer diameter 40 (shown in FIG. 1) of approximately 21 to 21¼ inches, leaving approximately a ½ inch to ¾ inch diametrical clearance between the collar inner perimeter 38 and the outer diameter 40 (shown in FIGS. 2 and 3) of the bottom wall 28 when the collar is inserted over the drum in the prior art (not shown).

Two ribs 42 are disposed on the bottom wall 28 to eliminate full diametrical clearance between the collar inner perimeter 38 and the outer diameter 40 of the bottom wall. The ribs 42 radially outwardly extend from the bottom wall 28 an amount such that the collar 36 can still be inserted over the drum 12 but the contact of the ribs and drum to the inner perimeter 38 inhibit the drum from rotating relative to the collar. The two ribs 42 increase contact between the inner perimeter 38 and the outer diameter 40 by causing the bottom wall 28 to distort out of round when the collar 36 is inserted over the drum 12 and ribs 42. By distorting out of round, an increased portion of the bottom wall 28 is urged into contact with the larger curvature of the collar inner perimeter 38, forming a contact area 43 in FIG. 2 and a contact area 50 in FIG. 3. Without the ribs 42, the smaller curvature of the bottom wall 28 relative to the collar inner perimeter 38 would have a much smaller contact area (not shown) if any contact was made at all between the bottom wall and the collar. The increased contact areas 43 and 50 result in the drum 12 being inhibited from rotating relative to collar 36.

In other words, an important, if not primary, function of the ribs 42 is to force off center the collar 36 from a concentric position on the flange, which would be the case were the collar to be dropped over the drum without the presence of ribs 42, to the illustrated off-center position, resulting in the larger contact area between the drum and the collar represented by the reference numeral 43, which contact area is generally opposed to the portion of the drum circumference containing the ribs 42. Not only does this result inhibit rotation of the drum relative to the collar, it also, perhaps more importantly, prevents inadvertent separation of the drum from the collar during field usage, which sometimes occurs, absent such ribs, because of the varying tolerances for the internal diameters of discarded truck tires.

In the preferred embodiment of the invention, the bottom wall 28 distorts upon insertion of the collar 36 over the drum 12 as the drum is much more flexible than the collar made from a truck tire. Other embodiments of the invention may include a collar that is relatively more flexible than the drum 12 resulting in the collar distorting out of round.

In the shown embodiment, the ribs 42 are vertically oriented and disposed within a latitudinal arc 44 of less than 180°. More specifically, in a preferred embodiment of the invention, the ribs 42 are disposed in an arc 46 of approximately 86°, as shown in FIG. 2. In another embodiment of the invention, the ribs 42 are disposed in an arc 48 of approximately 114°, as shown in FIG. 3.

The embodiment of the invention shown in FIG. 2 has a drum/collar contact region 43. The embodiment of the invention shown in FIG. 3 has a drum/collar contact region 50. The embodiment of the invention shown in FIG. 2 has a lesser drum/collar contact region 43 than the embodiment of the invention shown in FIG. 3. This is a result of the increased rib separation arc 48 relative to the rib separation arc 46 of the embodiment shown in FIG. 2. The wider the rib separation arc, the more distortion which occurs to the drum 12, resulting in a greater drum/collar contact region. Other embodiments of the invention will have other rib separation arcs of other values. Additionally, by being able to vary the rib separation arc value, collars 36 of various inner diameters may be accommodated by the traffic channeling device 10. Other embodiments of the invention may have more or fewer than the two ribs 42 which are illustrated and presently preferred.

Figure 7:
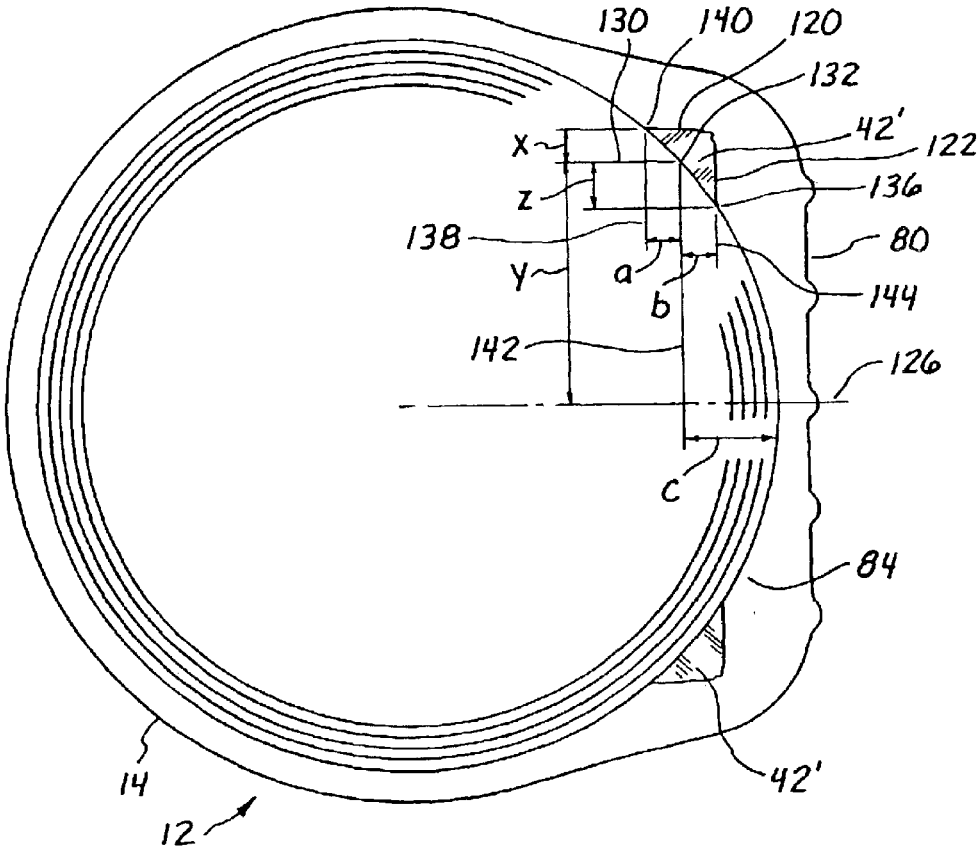
FIG. 7 is a schematic top view of an alternative embodiment of the invention, showing an anti-rotational rib which has been molded into the wall of the traffic safety drum.
Figure 8:
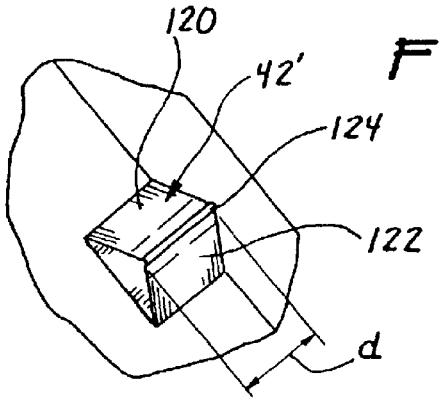
FIG. 8 is a perspective view, in isolation, of the molded rib shown in FIG. 7.

Referring now to FIGS. 4, 5, and 6, details of the ribs 42 are discussed. The rib 42 in this embodiment is preferably made of rubber having a hardness of approximately 35 to 40 durometer. Rubber ribs 42 of this hardness provide increased resistance to drum rotation when in contact with the collar inner perimeter 38. Other embodiments of the invention may have ribs made of rubber of other hardnesses or ribs of other suitable materials. In the illustrated embodiment of the invention, the ribs 42 are molded, but other embodiments of the invention may have ribs of other fabrications, including having the drum 12 and the ribs 42 being unitarily molded. Such an embodiment, which is presently preferred is illustrated in FIGS. 7 and 8, and will be discussed hereinbelow.

The rib 42 has an exterior surface 60, a back surface 62, and a thickness 64. The exterior surface 60 contacts the inner perimeter 38 of the collar 36 upon insertion of the collar over the drum 12. The back surface 62 is in contact with the bottom wall 28 of the drum 12. The thickness 64 extends between the exterior and back surfaces 60, 62. The rib 42 also has a bottom surface 66 and terminates at a tip 68. In embodiments of drums with unitarily molded ribs, the back surface of the rib corresponds to the outer curvature of the bottom wall 28.

In the illustrated embodiment of the invention, the height 70 of the rib 42 is 4¼ inches measured from the bottom portion 66 to the tip 68. The rib 42 has a width 72 of 1¾ inches. As shown in FIG. 5, at least a portion of the exterior surface 60 approximates a half cylinder shape and provides the rib 42 with an overall thickness 64 of ⅞ inches.

A top portion 73 of the rib 42 extends a distance 74 of 1⅝ inches from the tip 68. The top portion 73 diminishes in thickness toward the tip 68. The top portion 73 also diminishes in width toward the tip 68. Other embodiments of the invention may have ribs of other suitable dimensions and shapes. The rounded exterior surface 60 and non-abrupt changes in width 72 and thickness 64 at the top portion 73 of the rib 42 is to assist in guiding the collar 36 when inserted over the drum 12.

Referring specifically to FIG. 6, the drum 12 also has a base 80 that extends from a bottom edge 82 of the bottom wall 28. Embodiments of the invention may have a base 80 that comprises a radially outwardly and axially downwardly tapering skirt portion adjacent to the bottom edge 82 of the drum 12, as is disclosed in U.S. Pat. No. 5,234,280 to Cowan entitled "Traffic Channeling Devices," ("Cowan") which is expressly incorporated herein by reference in its entirety. Embodiments of the invention may also have a base 80 that is a flange that extends radially outwardly from the bottom edge 82 of the drum 12. Other embodiments of the invention may have bases of other shapes.

FIG. 6 also shows the back surface 62 of the rib 42 against the bottom wall 28 of the drum 12. The bottom surface 66 of the rib 42 is angled to complement the top surface 84 of the base 80. By complementing and resting on the base 80, the rib 42 is supported to inhibit the rib from being dislodged during the insertion of the collar 36 over the drum 12. Other embodiments of the invention may have rib bottom surfaces of other arrangements that may or may not complement the drum base 80.

As is shown in FIGS. 4, 5, and 6, the back surface 62 of the rib 42 has two cavities 88. The cavities 88 are shown aligned along the central axis 90 of the rib 42. In one embodiment of the invention, the cavities 88 are round and have a depth 89 of ⅛ inches, are ¾ inches in diameter, and are spaced on 1⅝ inch centers. In other embodiments of the invention, the rib 42 may have cavities of other shapes, depths, and alignments, and other amounts of cavities.

The cavities 88 respectively complement locator pins 92 that outwardly, radially extend from the bottom wall 28. An outer set 94 of two locator pins is shown on FIG. 1 to the left of the left most rib 42. The set 94 is also shown in FIG. 2. In one embodiment of the invention, the drum 12 has both the outer sets 94 and inner sets 96 of two locator pins, the inner sets 96 shown in FIG. 3. In the shown embodiment of the drum 12 in FIGS. 1 and 2, the ribs 42 are mounted on the inner locator pin set 96, thus locating the ribs 42 at an angular distance of 86°. In the shown embodiment of the drum in FIG. 3, the ribs 42 are mounted on the outer locator pin set 94, thus locating the ribs 42 at an angular distance of 114°. The locator pins 92 enable the ribs 42 to be precisely and accurately placed on each drum 12.

In one embodiment of the invention, the ribs 42 may be placed in any combination on the sets 94 and 96 of locator pins 92. Other embodiments of the invention may have more or less sets of locator pins 92, locator pins in different locations, or not have locator pins. The locator pins 92 facilitate placement of the ribs 42 both by the manufacturer of the traffic channeling device 10, and by users in the field, and while also facilitating changing the placement of the ribs.

Referring now to FIG. 6, in the illustrated embodiment of the invention, the ribs 42 are mounted to the bottom wall 28 using screws 100. The screws 100 extend radially outwardly such that a screw head 102 is disposed in the interior 103 of the drum, and a screw body 104 extends radially outwardly from the screw head 102, through the bottom wall 28, through the rib back surface 62, and into the rib 42. Other embodiments of the invention may use other fasteners, such as nails, staples, and a combination thereof. The fasteners may also extend radially inwardly from the exterior surface 60 in embodiments of the invention.

When drums 12 are stacked and nested, a potential exists for marring reflective sheeting 108 mounted to the plurality of axially spaced surfaces 20, 22, 24, 26, and 28 (shown only on surfaces 26 and 24 in FIG. 6). In the illustrated embodiment of the invention, the screw head 102 does not extend radially inwardly beyond the wall inside surface 106. By not extending beyond the wall inside surface 106, the screw head 102 cannot mar the reflective sheeting 108 during stacking of drums.

Instead of the screw head 102 extending beyond the wall inside surface 106, the screw head is disposed in a recess 110 that extends radially outwardly and complements the location pin 92. Other embodiments of the invention may have other arrangements for preventing marring of the reflective sheeting 108 by the screws 100. Other embodiments of the invention may have other fasteners and rib/bottom wall configurations that inhibit or prevent marring of the reflective sheeting 108.

In a presently preferred embodiment of the invention, there is shown in FIGS. 7 and 8 an alternative embodiment of the drum 12, wherein integrally molded ribs 42' are employed. As discussed above, in this embodiment, rather than utilizing separate attachable ribs 42, the ribs 42' are molded of the same plastic as the remainder of the drum 12, and are integral with the wall 14 of the drum. The ribs 42' may be located in positions identical to those discussed above, with respect to the earlier embodiments. In one particularly preferred embodiment, as illustrated, each rib 42' is generally triangular in shape, primarily for molding ease, having opposing side faces 120, 122, and a parting line ridge 124 at the intersection thereof. In the illustrated embodiment, a centerline 126 of the drum 12 is used as a reference for rib dimensions. As illustrated in FIGS. 7 and 8, distance x, from a line 128 extending from distal face 120 (relative to the centerline 126) of the rib 42', to a line 130 extending from a center point 132 of the rib 42', is 0.976 inches. A distance y, extending from the line 130 to the centerline 126, is 7.0 inches. A distance z, extending from the line 130 to a line 134 extending from a point of intersection 136 between the drum wall 14 and the face 122, is 1.495 inches. Thus, as shown in FIG. 8, a preferred width d of the rib 42' is 2.50 inches. Other dimensions of note include distance a (FIG. 7), from a line 138 extending from a point of intersection 140 between the drum wall 14 and the face 120, to a line 142, extending from the center point 132, which is 1.022 inches, as well as distance b, from the line 142 to a line 144 extending from the rib face 122, which is 1.136 inches. Distance c, extending from the line 142 to the wall 14 of the drum, along the centerline 126, is 2.717 inches, in the illustrated embodiment.

Of course, all of the foregoing dimensions are by way of example only, and may be changed as desired to accommodate design considerations for a particular application within the scope of the present invention.

The design, placement, and fastening of the ribs 42 on the drum 12 result in the inhibition of the drum rotating in the collar 36 and an aesthetically pleasing traffic channeling device 10 in the preferred embodiment of the invention. Although presently preferred embodiments of the present invention have been described in detail hereinabove, it should be clearly understood that many variations and/or modifications of the basic inventive concepts herein taught, which may appear to those skilled in the pertinent art, will still fall within the spirit and scope of the present invention, as defined in the appended claims.

What is claimed is:

1. A traffic channeling drum, comprising:

a wall having an outside surface and an inside surface and terminating at a lower end in a base flange having a top surface;

a ballasting collar disposed about said wall and over said base flange; and a plurality of integrally molded ribs disposed on said wall outside surface above said base flange;

said molded ribs being spaced relative to one another about a periphery of said wall outside surface, in contact with a portion of said ballasting collar, wherein distances between adjacent ones of said integrally molded ribs vary in length.

2. The traffic channeling drum as recited in claim 1, wherein said plurality of ribs comprises two ribs.

3. The traffic channeling drum as recited in claim 2, wherein said plurality of ribs are disposed within a 180 degree arc of said periphery.

4. The traffic channeling drum as recited in claim 1, wherein said plurality of integrally molded ribs and said drum are both comprised of plastic.

5. The traffic channeling drum as recited in claim 4, wherein said plastic comprises polyethylene.

6. The traffic channeling drum as recited in claim 1, wherein each of said plurality of ribs are generally triangular in shape, having opposing side faces.

7. The traffic channeling drum as recited in claim 1, wherein said ballasting collar is comprised of rubber.

8. A traffic channeling drum, comprising:

a wall having an outside surface and an inside surface and terminating at a lower end in abase flange having a top surface, said base flange extending about substantially all of a periphery of said wall outside surface; and a plurality of integrally molded ribs disposed on said wall outside surface directly above said base flange;

said molded ribs being spaced relative to one another about said periphery of said wall outside surface, wherein said plurality of integrally molded ribs are not spaced equidistantly about said periphery.

9. The traffic channeling drum as recited in claim 8, wherein said plurality of ribs comprises two ribs.

10. The traffic channeling drum as recited in claim 8, wherein said plurality of ribs are disposed within a 180 degree arc of said periphery.

11. A traffic channeling drum, comprising:

a wall having an outside surface and an inside surface and terminating at a lower end in a base flange having a top surface, said base flange extending about substantially all of a periphery of said wall outside surface; and a plurality of integrally molded ribs disposed on said wall outside surface directly above said base flange;

said molded ribs being spaced relative to one another about said periphery of said wall outside surface, wherein distances between adjacent ones of said plurality of integrally molded ribs vary in length.

12. The traffic channeling drum as recited in claim 8, wherein said plurality of integrally molded ribs and said drum are both comprised of plastic.

13. The traffic channeling drum as recited in claim 12, wherein said plastic comprises polyethylene.

14. The traffic channeling drum as recited in claim 8, wherein each of said plurality of ribs are generally triangular in shape, having opposing side faces.

15. The traffic channeling drum as recited in claim 8, and further comprising a ballasting collar disposed about said wall and over said base flange.

16. A traffic channeling drum, comprising:

a wall having an outside surface and an inside surface and terminating at a lower end in a base flange having a top surface;

a ballasting collar disposed about said wall and over said base flange; and a plurality of integrally molded ribs disposed on said wall outside surface above said base flange, said plurality of integrally molded ribs being spaced relative to one another about a periphery of said wall outside surface, but not being equidistantly spaced thereabout, in contact with a portion of said ballasting collar.

17. The traffic channeling drum as recited in claim 16, wherein said plurality of ribs comprises two ribs.

18. The traffic channeling drum as recited in claim 16, wherein said plurality of ribs are disposed within a 180 degree arc of said periphery.

19. The traffic channeling drum as recited in claim 16, wherein said plurality of integrally molded ribs and said drum are both comprised of plastic.

20. The traffic channeling drum as recited in claim 19, wherein said plastic comprises polyethylene.

21. The traffic channeling drum as recited in claim 16, wherein each of said plurality of ribs are generally triangular in shape, having opposing side faces.

22. The traffic channeling drum as recited in claim 16, wherein said ballasting collar is comprised of rubber.

23. A traffic channeling drum, comprising:

a wall having an outside surface and an inside surface and terminating at a lower end in a base flange having a top surface; and a plurality of integrally molded ribs disposed on said wall outside surface above said base flange;

said molded ribs being spaced relative to one another about a periphery of said wall outside surface, wherein distances between adjacent ones of said plurality of integrally molded ribs vary in length.

* * * * *